US006381939B1

(12) United States Patent
Brown et al.

(10) Patent No.: US 6,381,939 B1
(45) Date of Patent: May 7, 2002

(54) WIRE ROPE SLING AND METHODS OF MAKING SAME

(75) Inventors: Randall B. Brown, Humble; Charles L. McCarthy, Houston, both of TX (US)

(73) Assignee: Holloway Houston, Inc., Houston, TX (US)

( * ) Notice: Subject to any disclaimer, the term of this patent is extended or adjusted under 35 U.S.C. 154(b) by 0 days.

(21) Appl. No.: 09/773,852

(22) Filed: Feb. 2, 2001

(51) Int. Cl.[7] ..... B66C 1/12

(52) U.S. Cl. ..... 57/202; 294/74; 24/122.6; 57/362; 57/22

(58) Field of Search ..... 29/753; 24/122.6; 294/74; 57/22, 202, 362

(56) References Cited

U.S. PATENT DOCUMENTS 1,839,698 A * 1/1932 Novotny ..... 24/461
3,067,570 A * 12/1962 Nischan ..... 57/142
4,043,581 A * 8/1977 St. Germain ..... 294/74
4,215,463 A * 8/1980 Crook ..... 24/461
4,395,798 A * 8/1983 McVey ..... 24/122.6
6,170,145 B1 * 1/2001 Lucas ..... 29/517

* cited by examiner

*Primary Examiner*—Andy Falik
(74) *Attorney, Agent, or Firm*—Bill B. Berryhill

(57) ABSTRACT

A wire rope sling made of wire rope having a core and multiple strands of wire helically laid around the core and cut from a predetermined length. Approximately half of the strands of wire are separated from the core and the remaining strands of wire, shifted, relative to the core, a predetermined distance and rewoven with the core and remaining strands of wire into a continuous loop. A splicing sleeve surrounds first and second ends of the approximately half of the strands and a continuous section of the core and remaining strands in a tightly engaged manner and another splicing sleeve surrounds first and second ends of the core and the remaining strands and a continuous section of the approximately half of the strands in a tightly engaged manner.

16 Claims, 3 Drawing Sheets

WIRE ROPE SLING AND METHODS OF MAKING SAME

BACKGROUND OF THE INVENTION

1. Field of the Invention

The present invention pertains to wire rope slings. More specifically, the present invention pertains to an improved circular wire rope sling or grommet and methods of making the same.

2. Description of the Prior Art

Wire rope consists of three basic components: (1) a core, (2) wires which form a strand and (3) multi-wire strands laid helically around the core. The wire can be made of any number of materials including steel, iron, stainless steel, monel and bronze. The most widely used material is high carbon steel. Strands are made up of two or more wires laid in any one of many specific geometric arrangements, or in combination of steel wires with some other material such as natural or synthetic fibers.

The core of wire rope is made of materials which will provide proper support for the strands helically laid therearound under normal bending and loading conditions. Core materials include fibers (hard vegetable or synthetic) or steel. A steel core may consist either of a strand or independent wire rope.

The construction of wire rope varies by the way wires are laid to form strands and by the way the strands are laid around the core. Strands are typically laid into the rope, to the right, in a fashion similar to the threading of a right hand bolt, i.e. "right lay" rope. Conversely, "left lay" rope strands are laid in the opposite direction. Rope is also identified by the relationship of wires in the strands and may be identified as "regular lay", "lang lay" or "alternate lay" rope. The word "lay" simply means the manner in which the wires in a strand or the strands in a rope are helically laid. The term "lay length" is the distance measured parallel to the axis of the rope (or strand) in which a strand (or wire) makes one complete helical convolution about the core (or center).

Wire rope is frequently used to make slings for lifting heavy items. There are many types of slings which are identified by their particular construction or configuration. For example, there are single leg slings with sliding choker hooks, two leg bridal slings with sliding choker hooks, cable-laid slings with single rope legs, cable-laid slings with sliding choker hooks, multi-part braided slings and single leg slings with multi-part braided rope legs, etc.

A popular type of sling is the single circular or grommet sling in which a length of wire rope is cut, and the ends thereof joined in some manner to form a circle or loop. There are several styles of circular slings or grommets of the prior art which are identified by the way the ends are joined. In one style, the circular sling is totally strand laid and does not have any mechanical splices. In another style, wires of the rope are laid parallel at a splice point and held together by use of turn-back sleeves. This style of a sling does not have a splice at all and is subject to catastrophic failure when the sleeves fail. Another style sling requires the use of long splicing sleeves which hold the two ends together in a butt splice. Other circular slings or grommets have mechanically spliced joints which may require parallel strands and two splices at some point in the sling.

One of the problems in making and using slings of the prior art for large capacities is the increased length of the sling required by larger diameter wire rope. Thus, large capacity slings cannot be fabricated in the prior art in such a way as to allow for very low headroom conditions. Many times the headroom available for a large lift will not allow for the length needed. Therefore, such high capacity, low head room situations, have to be addressed with link plates, shackles or other specially engineered, costly and heavy solutions. Otherwise, the lift would have to be redesigned to allow for smaller lifts or longer slings. Longer slings permit greater movement of the load as the load gets further away from its attachment point and therefore lessen control of the load. Making numerous smaller lifts requires additional time, escalating the price of erection and/or removal of items being lifted. The same is true of the use of link plates or other specially engineered lifting devices.

SUMMARY OF THE PRESENT INVENTION

The present invention provides a wire rope sling and method of making the same in which the rope is cut a predetermined length to provide first and second ends of the core and wire strands. In a preferred embodiment, the rope comprises six strands of wire helically laid around a core. Three of the strands are separated from the core and the other three strands, shifted or displaced along side the core and other strands a predetermined amount and rewoven with the core and other strands of wire into a continuous loop, the first and second ends of the three strands meeting along a continuous section of the core and other strands, the first and second ends of the core and other strands meeting along a continuous section of the three strands. A first splicing sleeve surrounds the first and second ends of the three strands and the continuous section of core and other strands and a second splicing sleeve surrounds the first and second ends of the core and other strands and continuous section of the three strands in a tightly gripping manner. The circular sling or grommet constructed in this manner provides a relatively low cost, low headroom sling with greater lifting capacity than any of the prior art. Utilizing working load limit charts, correct pins and connecting points can be determined without guess work. The unique design of the sling of the present invention results in a shorter sling of greater capacity and better load control. Many other objects and advantages of the invention will be apparent from reading the description which follows in conjunction with the accompanying drawings.

DESCRIPTION OF A PREFERRED EMBODIMENT OF THE INVENTION

Figure 1:
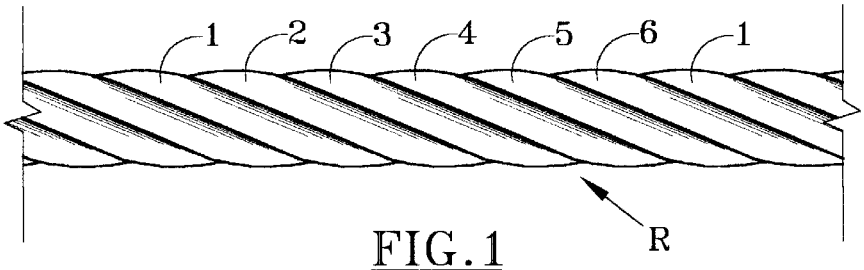
FIG. 1 is a longitudinal view of a section of wire rope in which six strands of wire are helically laid around a core in a right regular lay.
Figure 2:
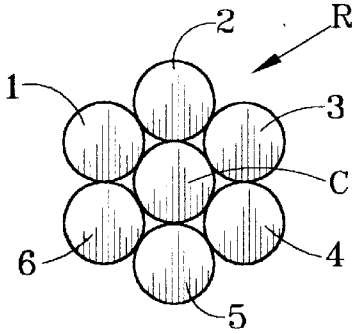
FIG. 2 is a cross-section of the wire rope of FIG. 1 showing the six strands thereof around a core.
Figure 4:
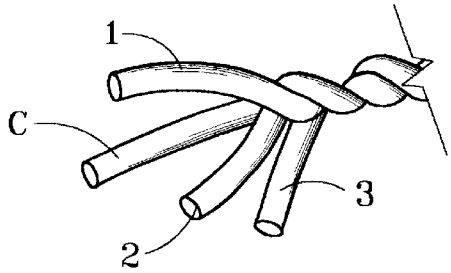
FIG. 4 is an enlarged pictorial view of one end of the core and three strands of wire rope utilized in making a circular sling or grommet with the wire rope of FIGS. 1 and 2 from which three strands of wire have been removed.

Referring first to FIGS. 1 and 2, there is shown a section of wire rope R comprising a core C and six strands of wire 1, 2, 3, 4, 5, 6 helically laid around the core. The lay length of the rope is approximately equal to the distance between the two reference numerals "1" in FIG. 1. The core C can be made of any suitable material which provides proper support for the strands 1–6 under normal bending and loading conditions, e.g. fibers or steel. If steel, the core may consist of a strand or an independent wire rope.

The strands are made of two or more wires, laid in any one of many specific geometric arrangements, or any combination of steel wires with other materials such as natural or synthetic fibers. A strand can be made up of any number of wires and the wire rope can be made of any number of strands. However, a six strand wire rope is most commonly used for circular slings or grommets.

Figure 3:
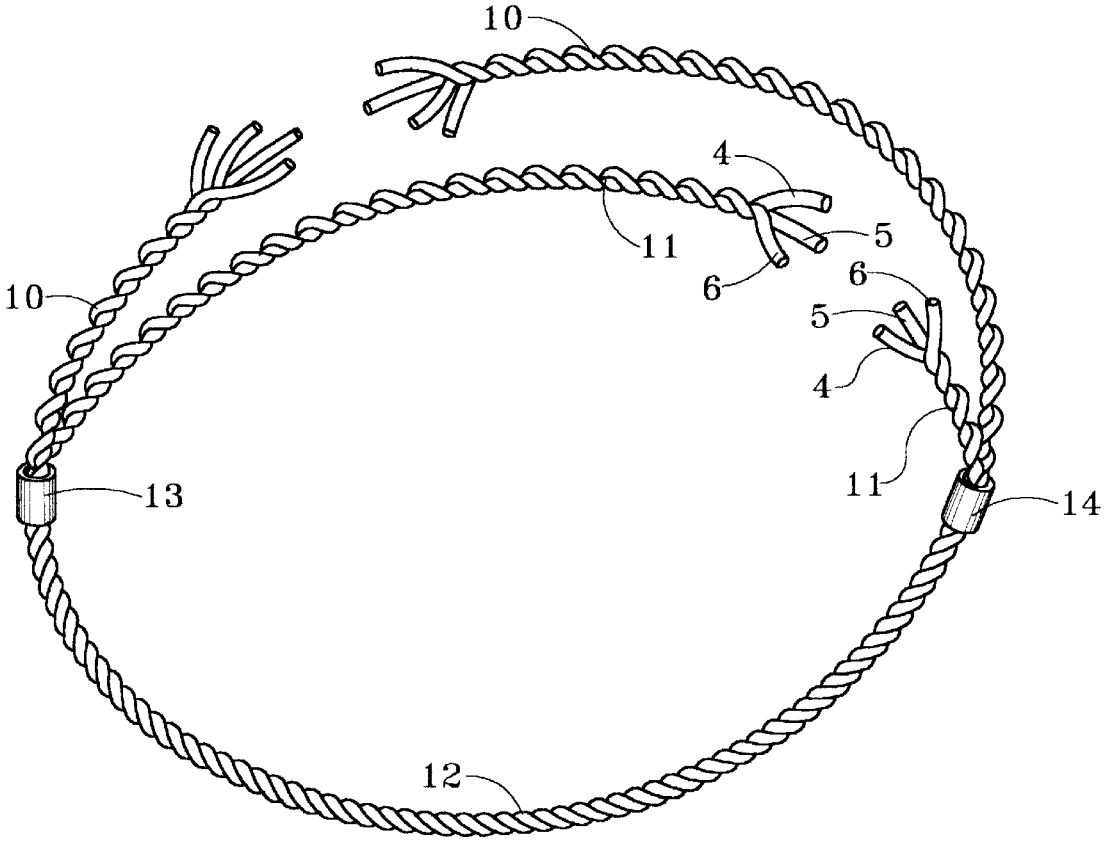
FIG. 3 is a pictorial view of a circular sling or grommet made from the wire rope of FIGS. 1 and 2 and illustrating initial steps in the making thereof.

In initial steps of making the sling or grommet of the present invention, the wire rope R is cut to a predetermined length to provide first and second ends of the core C and wire strands 1–6. Three of the strands 4, 5 and 6 are separated from the core C and the other strands 1, 2 and 3. The three strands 4, 5 and 6 are then shifted or moved along side the core C and other strands 1, 2, 3 by predetermined amount. Then the three strands 4, 5, 6 are rewoven with the core C and other three strands 1, 2, 3 to create a rope, substantially longer than the initially cut length, of three portions, a midportion 12 which comprises the three strands 4, 5, 6 rewoven with the core C and the other strands 1, 2, 3, an end portion 10 of the core C and three strands 1, 2, 3 and another end portion 11 of the strands 4, 5 and 6. While the end portions 10 and 11 are free, modified swaging or tubular splicing sleeves 13 and 14 are placed as shown in FIG. 3.

Figure 5:
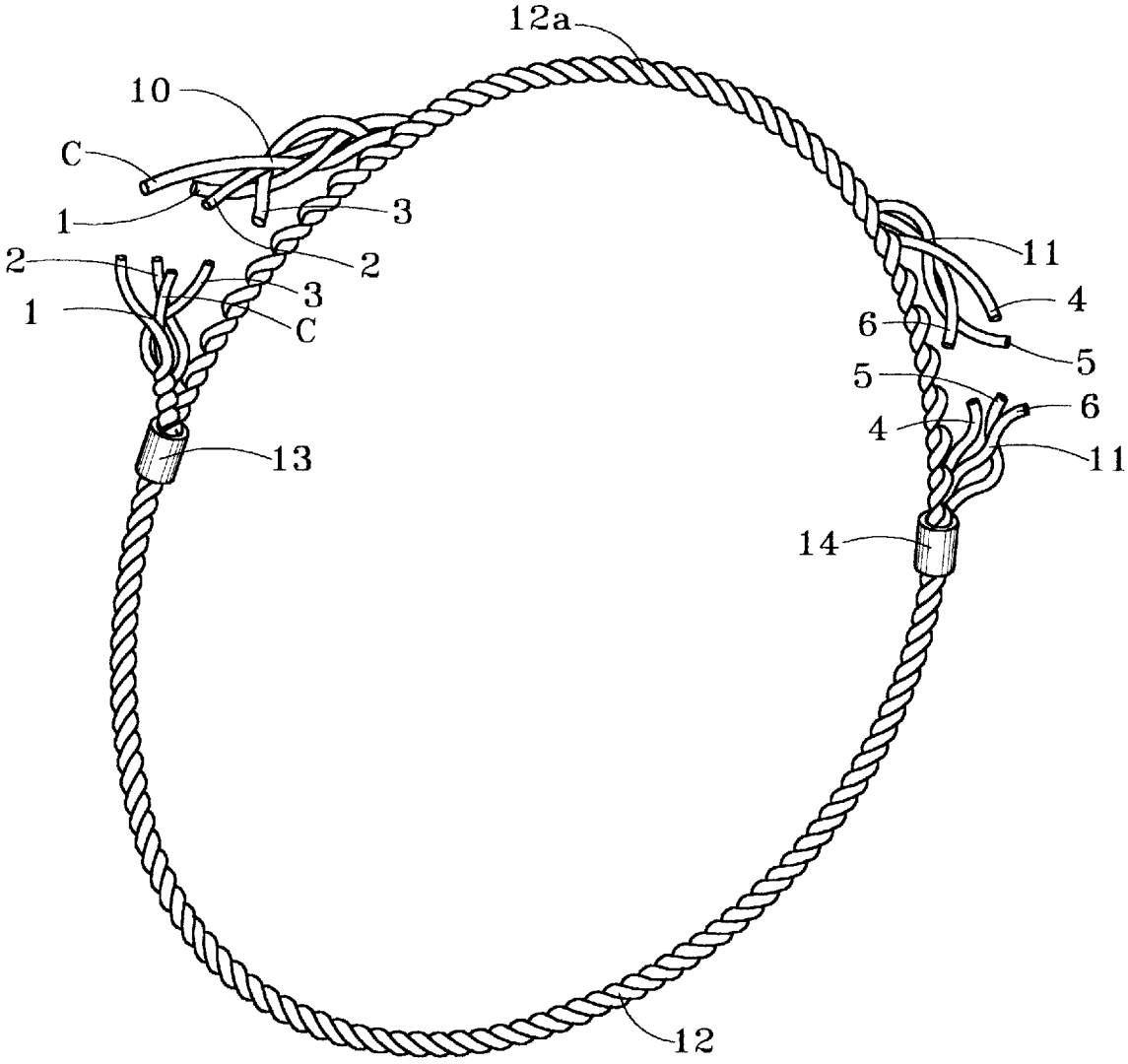
FIG. 5 is a pictorial view of the circular sling or grommet of the present invention, according to a preferred embodiment thereof and illustrating an intermediate step in the making thereof.

The end portions 10 and 11 are then brought together by reweaving the strands 1–6 and core C, as at 12*a,* to complete a continuous loop, this stage being substantially illustrated in FIG. 5. At this point the first and second ends of the strands 4, 5 and 6 meet along a continuous section of the core C and other strands 1, 2, 3 and the first and second ends of the core C and strands 1, 2, 3 meet along a continuous section of the three strands 4, 5 and 6.

When the first and second ends of the three strands 4, 5 and 6 and the first and second ends of the core C and strands 1, 2, 3 are brought together by reweaving they are brought together so the ends of the respective strands overlap each other by a distance substantially equal to one lay length of the wire rope R.

Figure 6:
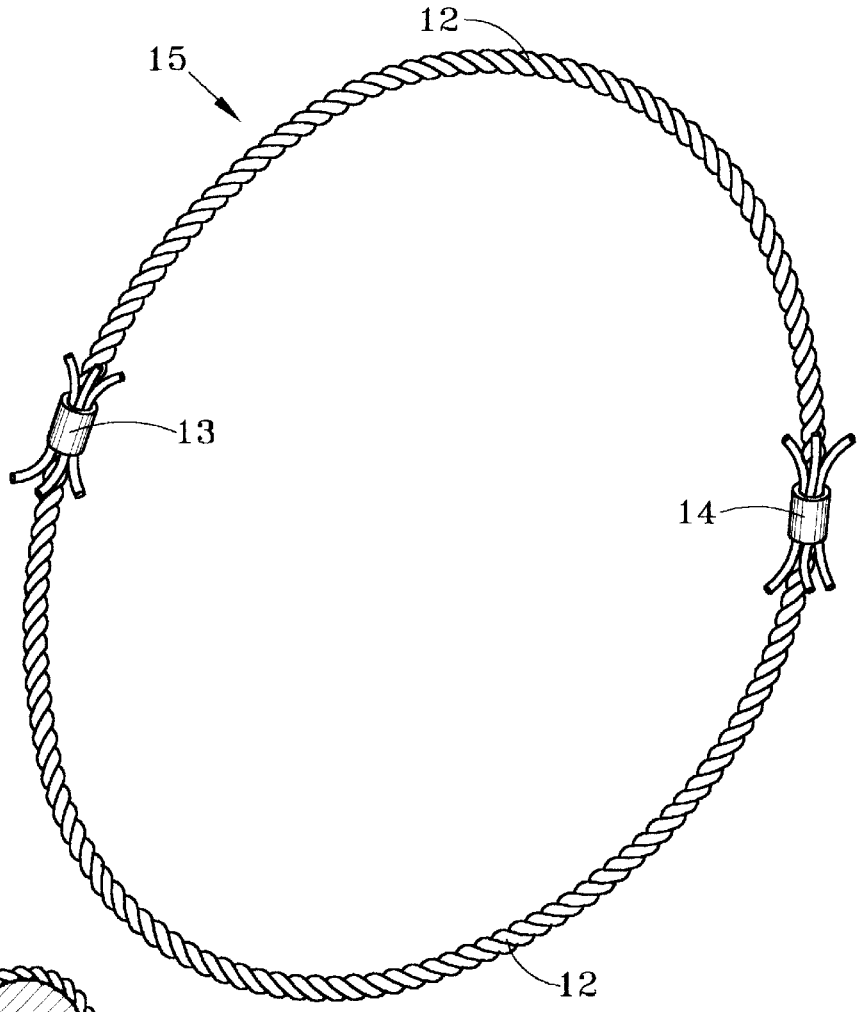
FIG. 6 is a pictorial view of the circular sling or grommet of the present invention, according to a preferred embodiment thereof, shown in its essentially complete form.

Then the first and second ends of the core C and three strands 1, 2, 3 and the continuous section of the three strands 1, 2, 3 are surrounded by the tubular splicing member 13 and the first and second ends of the three strands 4, 5, 6 and the continuous section of the core C and three strands of 1, 2, 3 are surrounded by tubular splicing member 14. These splicing members or modified swaging sleeves 13, 14 are then driven into place over the overlapping ends or tails of the core C and strands 1, 2, 3 and the strands 4, 5, 6, respectively, as in any Flemish eye or mechanically spliced sling. After the ends or tails are captured under these sleeves 13, 14, the sleeves 13 and 14 are pressed into tightly fixed and gripping engagement with the wire rope R resulting in a sling or a grommet 15 as shown in FIG. 6. It is preferred that the ends or tails of the strands 1, 2, 3 extend from underneath the sleeve or splicing member 13 and the ends or tails of the strands 4, 5, 6 extend from underneath the sleeve or splicing member 14 for visual observation thereof to allow for visual observation of any slippage which might require the sling to be removed from service. It is preferred that these ends or tails extend from underneath the sleeves 13, 14 by distance approximately equal to the diameter of the rope R.

Figure 7:
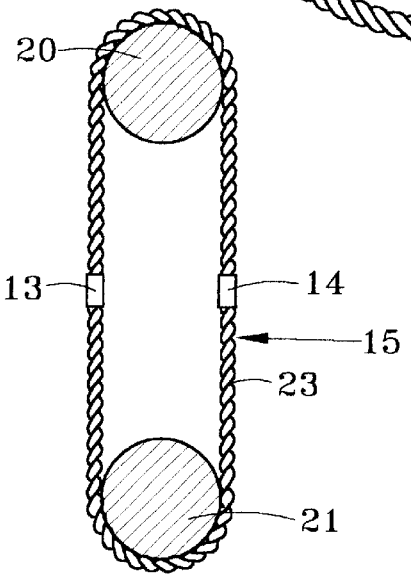
FIG. 7 is a schematic view of the completed circular sling of the present invention as it is tested.

After the sling or grommet 15 is completed, it is tested to twice its rated capacity around pin diameters of the size with which it is intended to be used. See for example, pins 20 and 21 in FIG. 7. The sling 15 under load, could then be strapped together to maintain its shape and have its eyes properly formed and set.

Figure 8:
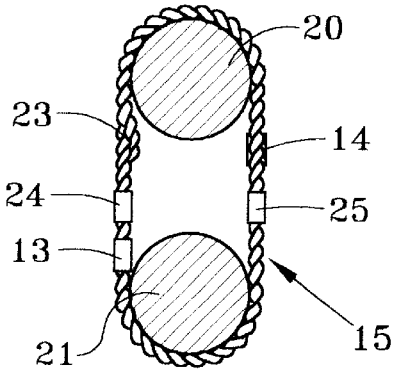
FIG. 8 is a schematic view of a doubled sling of the present invention as it is tested.

FIG. 8 illustrates the sling 15 doubled into two coils to form a sling of approximately half the length but twice the load capacity. In this configuration two portions of rope R would be side-by-side, crossing over each other at 23. While under such testing loads, the wires would be parallel at the bearing point of the eyes, preventing any crushing damage to the main wires such as is common in crossover points of other types of braided slings. The sling 15 would be situated so that the sleeves 13 and 14 would still be on opposite sides and well away from any bearing surfaces. One or more metal straps encircling side-by-side rope portions, such as straps 24 and 25 in FIG. 8, could assure that the doubled sling 15 remain in proper shape. A triple sling (not shown) could be formed in the same manner.

The sling of the present invention is uniquely constructed for high capacity lifts and low headroom. Its shorter length also provides greater load control. While two or three embodiments have been described herein, many variations can be made without departing from the spirit of the invention. Accordingly, it is intended that the scope of the invention be limited only by the claims which follow.

What is claimed is:

1. A wire rope sling made of wire rope having a core and multiple strands of wire helically laid around said core and cut from a predetermined length providing first and second ends, approximately half of said strands of wire having been separated from said core and remaining strands of wire, shifted relative to said core and remaining strands of wire a predetermined distance and rewoven with said core and remaining strands of wire into a continuous loop, the first and second ends of said approximately half of said strands meeting along a continuous section of said core and remaining strands, the first and second ends of said core and remaining strands meeting along a continuous section of said approximately half of said strands; a first splicing sleeve surrounding said first and second ends of said approximately half of said strands and said continuous section of said core and remaining strands in tight engagement therewith and a second splicing sleeve surrounding said first and second ends of said core and remaining strands and said continuous section of said approximately half of said strands in tight engagement therewith.

2. The wire rope sling of claim 1 in which said first and second ends of said approximately half of said strands overlap each other by approximately one lay length of said rope and said first and second ends of said core and remaining strands overlap each other by approximately one lay length of said rope where each is surrounded by said first and second splicing sleeves, respectively.

3. The wire rope sling of claim 2 in which said first and second ends of each of said approximately half of said strands and said core and remaining strands extend from said first and second splicing sleeves, respectively, by a distance substantially equal to the diameter of said rope.

4. The wire rope sling of claim 1 in which said first and second splicing sleeves are swaging sleeves which are swagingly driven into said tight engagement.

5. The wire rope sling of claim 1 in which said continuous loop is doubled to form two interconnected loops.

6. The wire rope sling of claim 1 in which said continuous loop is coiled to form at least two interconnected loops.

7. The wire rope sling of claim 1 including one or more straps placed around said wire rope to maintain the proper shape thereof.

8. A wire rope sling made of wire rope having a core and six strands of wire helically laid around said core and cut from a predetermined length providing first and second ends of said core and wire strands, three of said strands having been separated from said core and the other three of said strands, shifted relative to said core and other three strands a predetermined distance and rewoven into a continuous loop, the first and second ends of said three strands meeting along a continuous section of said core and other three strands, the first and second ends of said core and other three strands meeting along a continuous section of said three strands, a first splicing sleeve surrounding said first and second ends of said three strands and said continuous section of said core and other three strands in a tightly engaged manner and a second splicing sleeve surrounding said first and second ends of said core and three other strands and said continuous section of three strands in a tightly engaged manner.

9. The wire rope sling of claim 8 in which said first and second ends of said three strands overlap each other and said first and second ends of said core and other three strands overlap each other where they are surrounded by said first and second splicing sleeves respectively.

10. The wire rope sling of claim 9 in which the length of overlap of said three strands and of said core and other three strands is approximately equal to one lay length of said rope.

11. The wire rope sling of claim 9 in which said overlapping ends of said three strands and said overlapping ends of said core and other three strands extend slightly from said surrounding first and second splicing sleeves, respectively.

12. The wire rope sling of claim 11 in which the amount of said extension of said overlapping ends of said three strands and said overlapping ends of said core and other three strands is substantially equal to the diameter of said wire rope.

13. The wire rope sling of claim 8 in which said continuous loop thereof is coiled over itself to form two or more side by side interconnected loops.

14. A method of making a wire rope sling from a wire rope having a core and six or more strands of wire helically laid around said core comprising the steps of:

cutting a predetermined length of rope to provide first and second ends of said core and wire strands;

separating three or more of said strands from said core and other strands;

shifting said three or more strands along side said core and other strands, a predetermined amount;

reweaving said three or more strands with said core and other strands to create a rope of three portions, a midportion which comprises said three or more strands rewoven with said core and other strands, an end portion of said three or more strands and another end portion of said core and other strands;

bringing said end portions together by reweaving said three or more strands with said core and other strands to form a continuous loop, the first and second ends of said three or more strands meeting along a continuous section of said core and other strands, the first and second ends of said core and other strands meeting along a continuous section of said three or more strands;

surrounding said first and second ends of said three or more strands and said continuous section of said core and other strands with a first tubular splicing member;

surrounding said first and second ends of said core and other strands and said continuous section of said three or more strands with a second tubular splicing member; and forcing said first and second splicing members and the wire strands surrounded thereby into fixed engagement.

15. The method of making a wire rope sling as set forth in claim 14 in which said bringing together of said first and second ends of said three or more strands and said first and second ends of said core and other strands is done in a manner so that the ends of said strands overlap each other by a distance substantially equal to one lay length of said rope.

16. The method of making a wire rope sling as set forth in claim 15 in which said first and second splicing members are placed so that said ends of said strands extend from said splicing members for visual observation thereof.

* * * * *